US008641169B2

(12) United States Patent
Ishii et al.

(10) Patent No.: US 8,641,169 B2
(45) Date of Patent: Feb. 4, 2014

(54) LIQUID EJECTING APPARATUS

(75) Inventors: Hiroyuki Ishii, Shiojiri (JP); Munehide Kanaya, Azumino (JP)

(73) Assignee: Seiko Epson Corp., Tokyo (JP)

( * ) Notice: Subject to any disclaimer, the term of this patent is extended or adjusted under 35 U.S.C. 154(b) by 166 days.

(21) Appl. No.: 13/198,031

(22) Filed: Aug. 4, 2011

(65) Prior Publication Data

US 2012/0038708 A1 Feb. 16, 2012

(30) Foreign Application Priority Data

Aug. 12, 2010 (JP) ..... 2010-181087

(51) Int. Cl.
*B41J 11/22* (2006.01)

(52) U.S. Cl.
USPC ..... 347/37

(58) Field of Classification Search
USPC ..... 347/40–43, 47, 37
See application file for complete search history.

(56) References Cited

U.S. PATENT DOCUMENTS 6,206,499 B1 3/2001 Iijima et al.
2010/0086687 A1 * 4/2010 Hayashi et al. ..... 427/256

FOREIGN PATENT DOCUMENTS

JP 2000-190513 7/2000

* cited by examiner

*Primary Examiner* — Lamson Nguyen
(74) *Attorney, Agent, or Firm* — Workman Nydegger

(57) ABSTRACT

A liquid ejecting apparatus includes a liquid ejecting head unit having a plurality of liquid ejecting heads that ejects liquid from nozzles. The liquid ejecting head unit has a head fixing member that fixes a plurality of the liquid ejecting heads in a row with gaps between the heads. The head fixing member has an opening at a frame section, and fixes a plurality of the liquid ejecting heads that are inserted into the opening in a state where at least one portion of each of the nozzle plates protrudes through the opening. Partition plates are arranged between the liquid ejecting heads in the frame section in a row with the liquid ejecting heads across the opening. A portion of each of the partition plates protrudes from the bottom of the frame section.

6 Claims, 15 Drawing Sheets

LIQUID EJECTING APPARATUS

The entire disclosure of Japanese Patent Application No: 2010-181087, filed Aug. 12, 2010 is expressly incorporated by reference herein.

BACKGROUND

1. Technical Field

The present invention relates to a liquid ejecting apparatus such as an ink jet printer having a liquid ejecting head that ejects liquid inside a pressure chamber through nozzles, by providing pressure fluctuations to the pressure chamber that communicates with the nozzles.

2. Related Art

Liquid ejecting apparatuses have a liquid ejecting head that ejects (discharges) various liquids. Examples of such liquid ejecting apparatuses include, for instance, an image recording apparatus such as an ink jet printer (hereinafter referred to as a printer) which has an ink jet recording head (referred to as a recording head hereinafter) as a liquid ejecting head, and records images or the like by ejecting liquid ink droplets from the nozzles of the recording head and causing one liquid ink droplet to strike a recording medium (ejection target) such as recording paper. Recently, application of such apparatuses has not been limited to only such an image recording apparatus but has been extended to other manufacturing devices. For instance, in display manufacturing devices such as liquid crystal displays, plasma displays, organic EL (Electro Luminescence) displays or FEDs (Field Emission Displays), liquid ejecting apparatuses are used in which various liquid materials such as color materials or electrodes are ejected toward a pixel forming area or an electrode forming area.

In such a recording head, for example, a frame-shape head cover in which a nozzle plate is exposed through an opening, is mounted on a head case so as to protect the nozzle plate from a recording medium which shifts in relation to the recording head (see, for instance, JP-A-2000-190513). So-called multi-head printers have also been proposed in which a plurality of recording heads, having a plurality of nozzles provided in rows as nozzle groups, are arranged and fixed to a head fixing member, such as a sub-carriage, as one head unit.

In the multi-head printers, openings are provided at a sub-carriage, and a plurality of recording heads are inserted through the openings and fixed. Thus, with additional recording heads fixed to a sub-carriage, the sub-carriage will have greater area for openings and thus lose its rigidity. Accordingly, the recording heads mounted in alignment with the sub-carriage having lower rigidity are often displaced from a certain position and the positions of ejected liquid droplets thus deviate more when the sub-carriage is deformed by external force, such as vibration or contact with an ejection target such as a recording medium.

Also, a sub-carriage often has protective protrusions so as to protect the sides and the nozzle plates of the recording heads from a recording medium being transported, or the like. The protective protrusions are mounted at ends parallel to the recording heads in the sub-carriage, and protrude downward close to the nozzle plates of the recording heads (to the side of the recording medium during recording), parallel to the sides of the recording heads. However, since the protective protrusions are arranged outside of and parallel to the recording heads, the recording heads spaced away from the protective protrusions (the center recording heads) are insufficiently protected while the recording heads close to the protective protrusions (the recording heads at the ends of the row) are protected. As a result, when a transported recording medium or the like contacts a recording head, the recording head is displaced by the shock thereby and the impact locations of liquid droplets become less accurate.

SUMMARY

An advantage of some aspects of the invention is that a liquid ejecting apparatus is provided that can improve the accuracy of droplet impact locations.

A liquid ejecting apparatus according to an aspect of the invention has a liquid ejecting head unit with a plurality of liquid ejecting heads that eject liquid from nozzles; the liquid ejecting head unit has a head fixing member that fixes a plurality of the liquid ejecting heads in a row with gaps therebetween; the head fixing member has an opening at a frame section and fixes a plurality of the liquid ejecting heads that are inserted into the opening in a state where at least one portion of the nozzle plates protrudes; partition plates are arranged between the liquid ejecting heads at the frame section in a row with the liquid ejecting heads across the opening; and a portion of the partition plates protrudes from the bottom of the frame section.

The bottom of the frame section is a side facing an ejection target when liquid is ejected from the nozzles toward the ejection target such as a recording medium.

The liquid ejecting head unit has the head fixing member for fixing a plurality of the liquid ejecting heads in a row with gaps therebetween; the head fixing member has an opening at a frame section and fixes a plurality of the liquid ejecting heads that are inserted into the opening in a state where at least one portion of the nozzle plates protrudes; partition plates are arranged between the liquid ejecting heads at the frame section in a row with the liquid ejecting heads across the opening; and a portion of the partition plates protrudes from the bottom of the frame section. Thus, since the partition plates function as beams with their rigidity, the frame section is more rigid. In other words, as the edges of the opening are connected to each other with the partition plates, the frame section can be reinforced. Accordingly, the head fixing member is prevented from being deformed even with external force such as vibration or shock. Thus, even if an external force acts on the head fixing members, each liquid ejecting head will not be displaced. Therefore, each liquid ejecting head mounted to the head fixing member in alignment, and the nozzles can be positioned more precisely. As a result, the impact positions of liquid droplets onto an object can become more accurate. Moreover, gaps between the liquid ejecting heads are blocked by the partition plates, so that even if mist is generated at the nozzle plates by ejecting liquid from the nozzles, the mist does not easily travel to the side opposite the nozzle plates in the head fixing member. Accordingly, the liquid ejecting heads become more reliable. For instance, when an electronic component such as an electrical substrate is arranged on the side opposite the nozzle plates, liquid such as mist is prevented from adhering to the electronic component. Furthermore, when the liquid ejecting heads are inserted through the opening, the partition plates can be used so as to guide the liquid ejecting heads to a mounting position. Therefore, the liquid ejecting heads are easily assembled.

It is preferable that the frame section have a pair of first frame members provided parallel to each other, and a pair of second frame members connected to the ends of the first frame members so as to surround the opening; that the partition plates be suspended between the first frame members; and that the frame section have end plates that are outside of the liquid ejecting heads located at the ends in the row direction of the liquid ejecting heads and that protrude along side surfaces located in the row direction of the liquid ejecting heads from the second frame members.

The frame section has a pair of the first frame members provided parallel to each other, and a pair of the second frame members connected to the ends of the first frame members so as to surround the opening. The partition plates are suspended between the first frame members. The frame section has the end plates that are outside of the liquid ejecting heads located at the ends in the row direction of the liquid ejecting heads and that protrude along side surfaces located in the row direction of the liquid ejecting heads from the second frame members. Thus, the frame section can be reinforced with the partition plates and the end plates. Moreover, the end plates can protect the sides and the nozzle plates of the liquid ejecting heads at the ends parallel to the liquid ejecting heads against an ejection target such as a recording member carried to a region facing the nozzle plates while liquid is ejected from the nozzles to the ejection target. Accordingly, the liquid ejecting heads can be prevented from being displaced.

It is preferable that the edges of at least one of the partition plates and the end plates protrude from the nozzle plates of the liquid ejecting heads outward from the frame section.

The edges of at least one of the partition plates and the end plates extend from the frame section more than the nozzle plates of the liquid ejecting heads. Thus, both sides in the row direction of each liquid ejecting head fixed to the head holding member and the nozzle plates can be protected from a transported object such as a recording member.

It is preferable that the liquid ejecting head unit include a channel member having an internal liquid channel that supplies liquid to a liquid ejecting head, for each liquid ejecting head, and that at least either one of the partition plates and the end plates have fixing sections at rear ends on the opposite side from the frame section so as to fix the channel members individually.

The liquid ejecting head unit has a channel member having an internal liquid channel that supplies liquid to the liquid ejecting head, for each liquid ejecting head, and at least either one of the partition plates and the end plates have fixing sections at the rear on the opposite side from the frame section so as to fix the individual channel members. Thus, the channel members can be easily fixed to the head fixing member without separately providing fixing sections. Moreover, just the channel members can be removed from the head fixing member, so that an individual channel member can be replaced easily.

It is preferable that the head fixing member be metallic and have a heater.

The head fixing member is metallic and has a heater, so that the sides of the liquid ejecting heads can be efficiently heated by heating the head fixing member arranged between the liquid ejecting heads. Therefore, a liquid having a higher viscosity than conventional liquids can be easily ejected.

It is preferable that the end plates be integrated with the head fixing member.

Since the end plates are provided so as to be integrated with the head fixing member, the number of components can be reduced and assembly is simplified.

BRIEF DESCRIPTION OF THE DRAWINGS

The invention will be described with reference to the accompanying drawings, wherein like numbers reference like elements.

DESCRIPTION OF EXEMPLARY EMBODIMENTS

An embodiment of the present invention will be described with reference to the accompanying drawings. Although there are various limitations on a preferable example of the invention in the following embodiment, the invention is not limited to the embodiment as long as there is no particular description that limits the invention below. A liquid ejecting apparatus of the invention is applied to an ink jet recording apparatus (hereinafter referred to as a printer) in the following embodiment.

Figure 1:
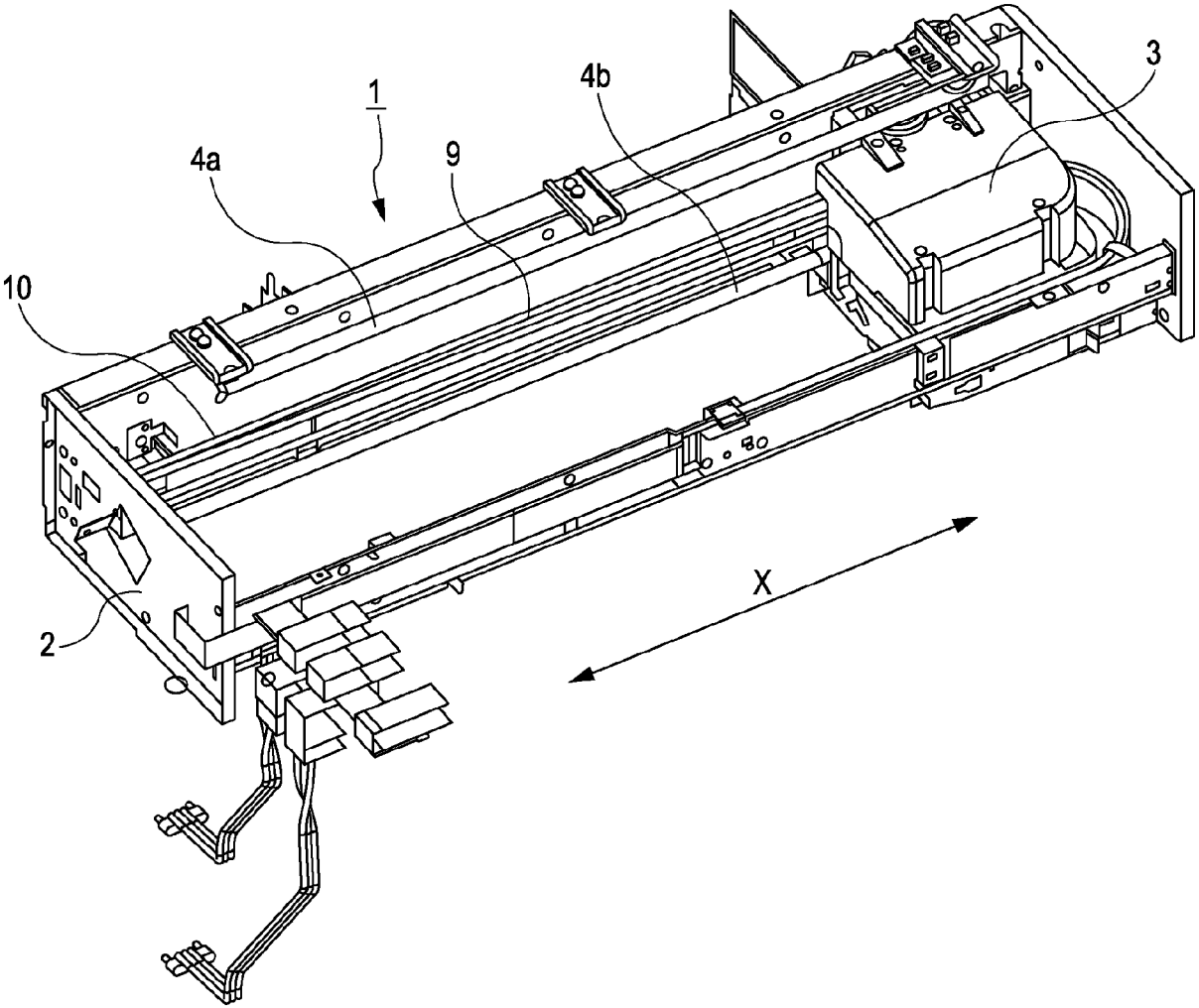
FIG. 1 is a perspective view, illustrating a portion inside a printer.
Figure 2:
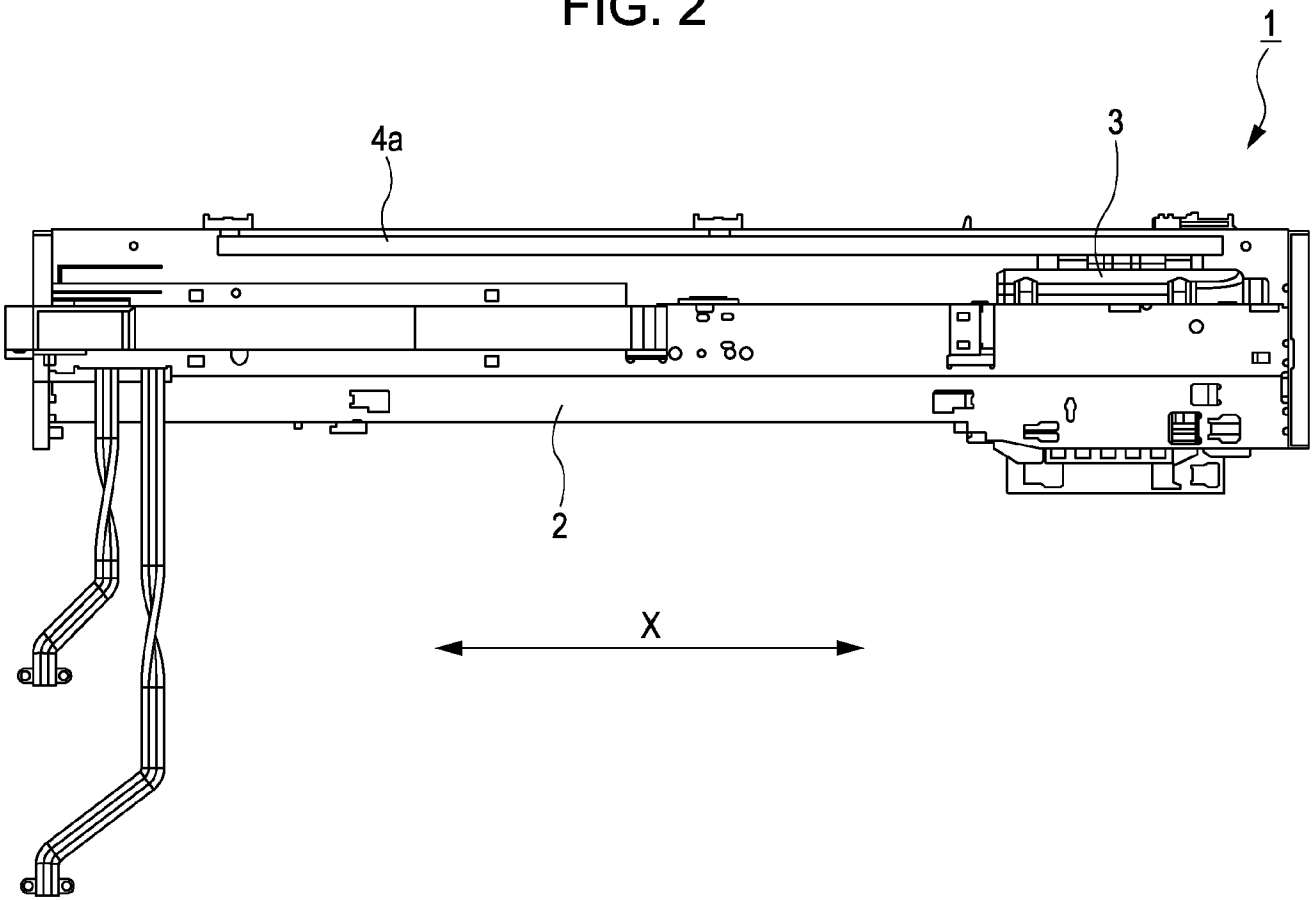
FIG. 2 is an elevation view of the printer.
Figure 3:
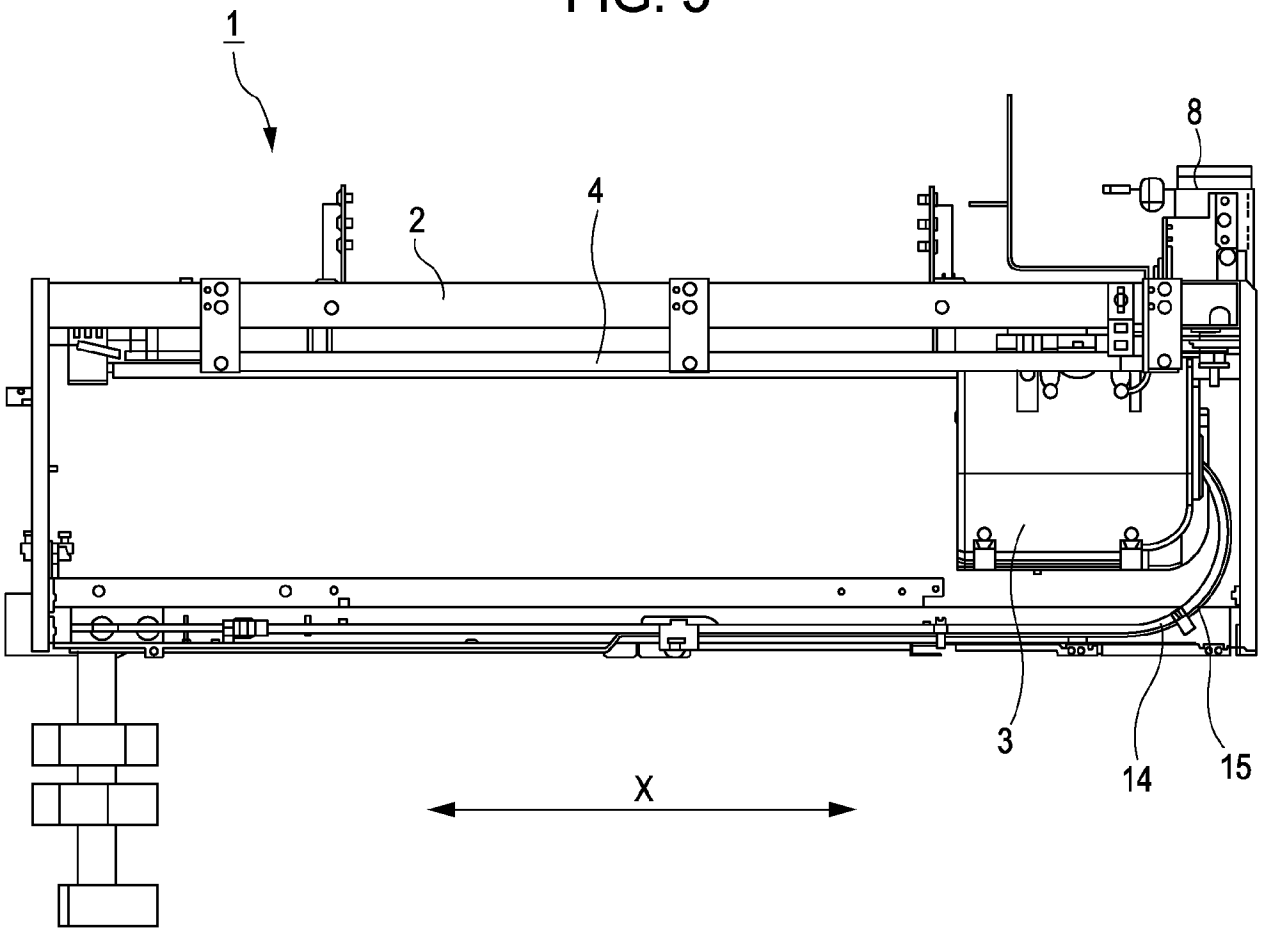
FIG. 3 is a plan view of the printer.
Figure 4:
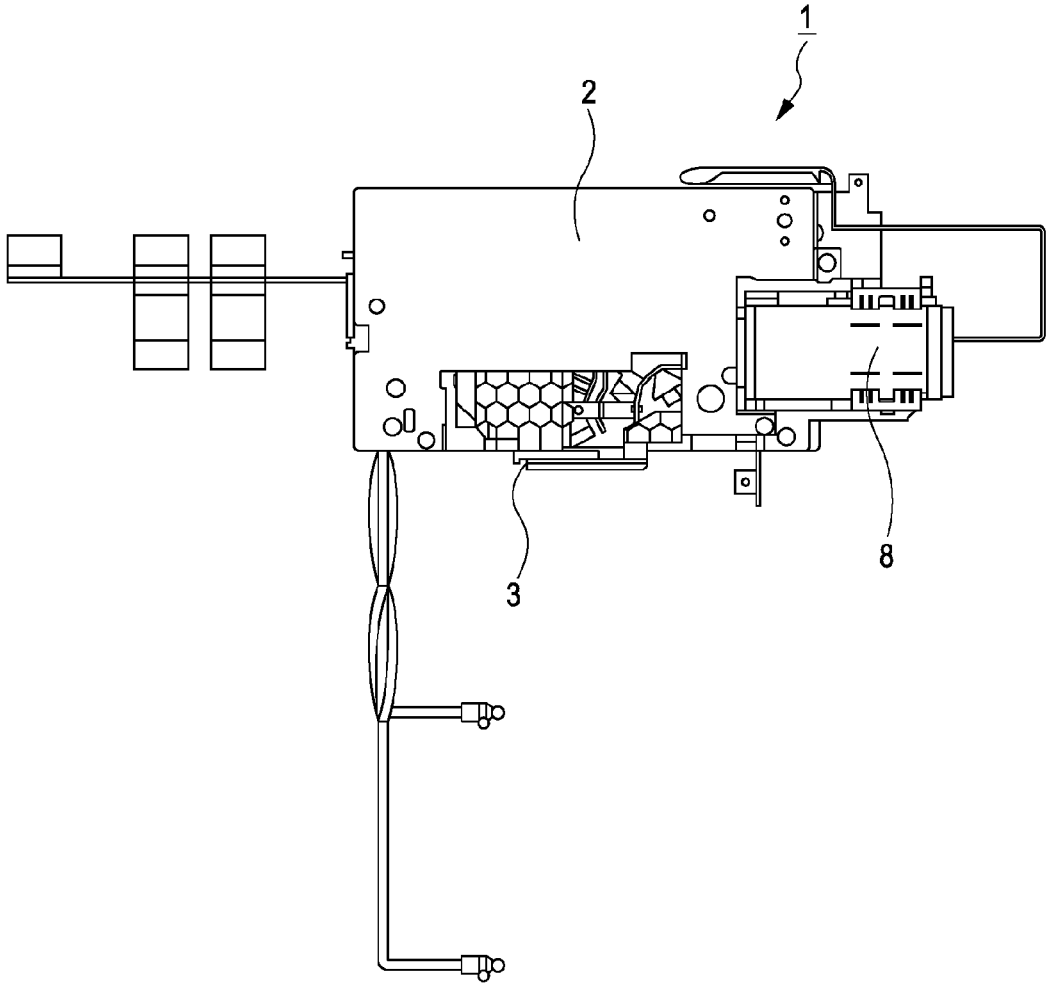
FIG. 4 is a right side view of the printer.

FIG. 1 is a perspective view, illustrating a portion inside a printer 1; FIG. 2 is an elevation view of the printer 1; FIG. 3 is a plan view of the printer 1; and FIG. 4 is a right side view of the printer 1. The illustrated printer 1 ejects a liquid ink toward a recording medium (ejection target) such as recording paper, cloth or film (not shown in the figures). The printer 1 has a carriage assembly 3 inside a frame 2 which is installed so as to shift back and forth in a main scanning direction (illustrated with an arrow X in FIG. 1), which is a direction that intersects the feeding direction of a recording medium. A pair of top and bottom guide rods 4*a* and 4*b*, which are elongated in the longitudinal direction of the frame 2, are mounted parallel to each other with gaps therebetween on the inner wall of the frame 2 on the back side of the printer 1. The carriage assembly 3 is supported in a slidable manner relative to the guide rods 4*a* and 4*b* by joining the guide rods 4*a* and 4*b* to a bearing section 7 on the back of the carriage assembly 3 (see FIG. 5).

At one end of the main scanning direction X on back side of the frame 2 (right end in FIG. 3), a carriage motor 8 is provided as a driving source to shift the carriage assembly 3. The driving shaft of the carriage motor 8 protrudes inward from the back side of the frame 2, and a driving pulley (not shown) is connected to the tip of the driving shaft. This driving pulley is rotated by the carriage motor 8 being driven. On the end opposite the driving pulley in the main scanning direction X (left end in FIG. 3), a free pulley (now shown) is provided. A timing belt 9 is suspended across the pulleys. The carriage assembly 3 is connected to the timing belt 9. When the carriage motor 8 is driven, the timing belt 9 rotates along with the rotation of the driving pulley and the carriage assembly 3 shifts in the main scanning direction X along the guide rods 4*a* and 4*b*.

On the inner wall of the back side of the frame 2, a linear scale 10 (encoder film) is provided under tension, parallel to the guide rods 4*a* and 4*b* along the main scanning direction X. The linear scale 10 is a band-shaped member made of a transparent resin film; for instance, a transparent base film printed with a plurality of opaque stripes on the surface across the width of the band. The stripes have the same width and are formed at a constant pitch in the longitudinal direction of the band. On the back side of the carriage assembly 3, a linear encoder is provided so as to optically read the stripes of the linear scale 10 (not shown). The linear encoder consists of, for example, a pair of a light emitting element and a light receiving element which face each other, and outputs an encoder pulse based on the difference in light reception between the transparent section and the stripe section of the linear scale 10. Specifically, the linear encoder is a type of a position information output means, and outputs an encoder pulse in response to the scanning position of the carriage assembly 3 as position information in the main scanning direction X. Thus, the controller of the printer 1 (not shown) can control the recording motions of a head unit 17 relative to a recording medium by recognizing the scanning position of the carriage assembly 3 based on an encoder pulse from the linear encoder. The printer 1 is configured so as to record letters, images and so forth on recording paper by shifting the carriage assembly 3 in both directions: forward direction from one end of the main scanning direction X as a home position to the opposite end (full position) and backward direction from the full position to the home position, so that so-called bidirectional recording becomes possible.

As shown in FIG. 3, ink supply tubes 14 for supplying each color ink to each recording head 18 in the head unit 17, and a signal cable 15 that supplies signals such as drive signals are connected to a carriage assembly 3. Though not illustrated in the figures, the printer 1 also has a cartridge mounting section to which an ink cartridge (liquid supply source) that stores ink is detachably fixed, a transporting section that transports recording paper, and a capping section that caps nozzle plates 53 (see FIG. 7B) of the recording heads 18 in a standby condition.

Figure 5:
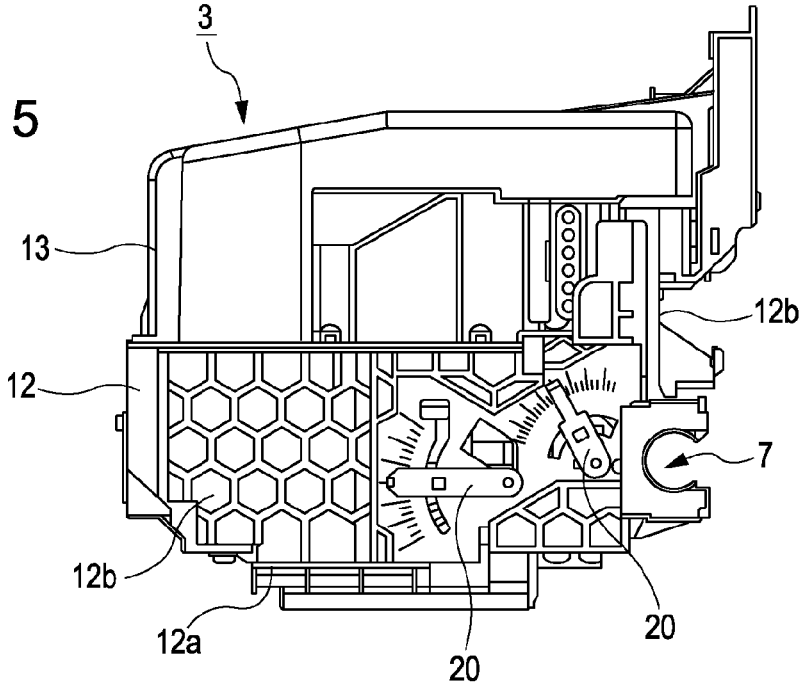
FIG. 5 is a right side view of a carriage assembly.
Figure 6:
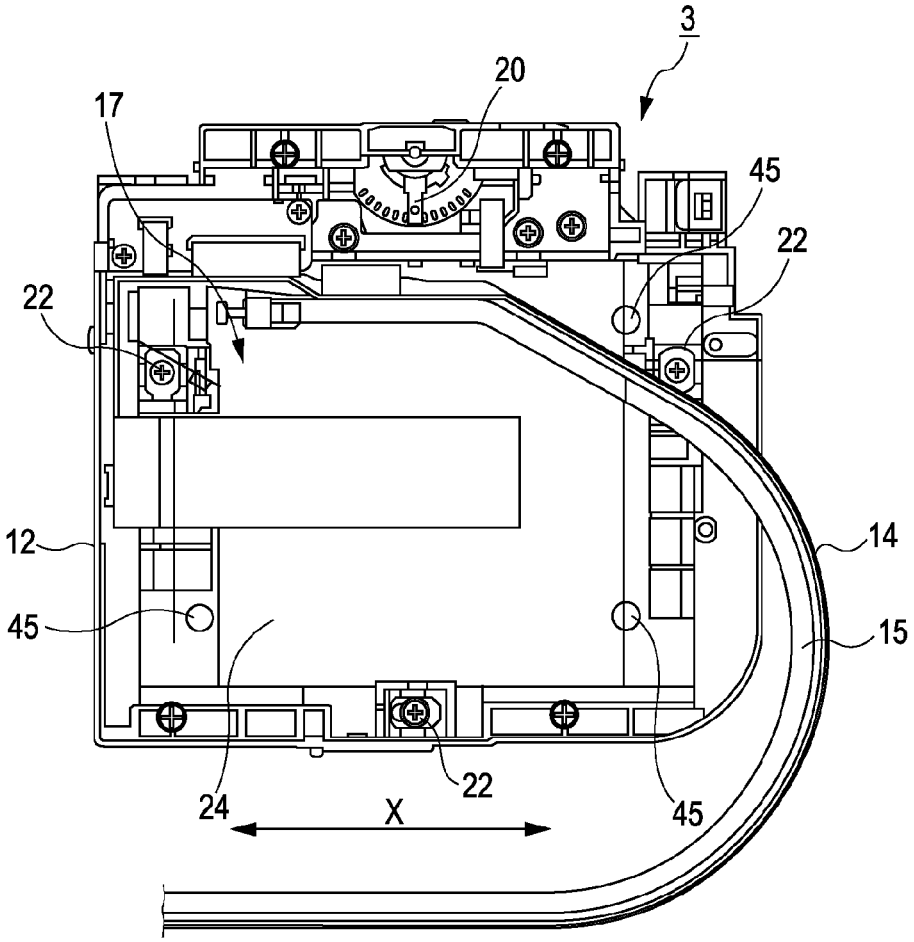
FIG. 6 is a plan view of the carriage assembly.

FIG. 5 is a right side view of the carriage assembly 3; FIG. 6 is a plan (top) view of the carriage assembly 3. FIG. 6 illustrates the assembly without the carriage cover 13. The carriage assembly 3 consists of a carriage main body 12 in which the head unit 17 described below (a type of liquid ejecting head unit in the invention) is installed and a carriage cover 13 that covers the top opening of the carriage main body 12, and is a hollow box-shaped member which can be vertically divided. The carriage main body 12 has a roughly rectangular bottom plate section 12*a* and side wall sections 12*b* which rise from each of four outer peripheral edges of the bottom plate section 12*a*, and stores the head unit 17 inside a space surrounded by the bottom plate section 12*a* and the side wall sections 12*b*. The bottom plate section 12*a* has a bottom opening (not shown) through which the nozzle plate 53 of each recording head 18 of the housed head unit 17 is exposed. In a state where the head unit 17 is housed inside the carriage main body 12, the nozzle plate 53 of each recording head 18 protrudes from the bottom opening of the bottom plate section 12*a* downward from the bottom of the carriage main body 12 (toward a recording medium during recording).

Between the carriage main body 12 and the head unit 17, a plurality of eccentric cams (not shown) are provided to adjust the position of the head unit 17 housed in the carriage main body 12. The carriage main body 12 also has a plurality of adjustment levers to rotate the eccentric cams. Along with the operation of the adjustment levers 20, the eccentric cams rotate, and cam diameters from the rotational centers to the outer peripheral surfaces vary. The variations of the cam diameters adjust the position and inclination of the head unit 17 housed in the carriage main body 12 relative to the carriage main body 12.

Figure 7A:
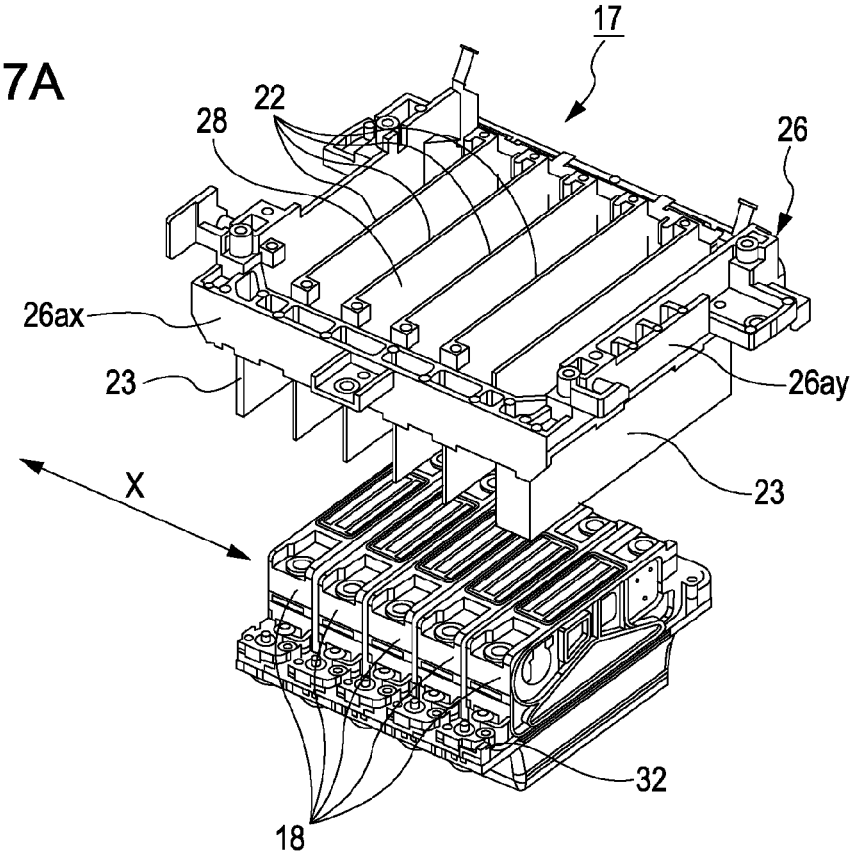
FIGS. 7A and 7B are exploded perspective views of a head unit.
Figure 7B:
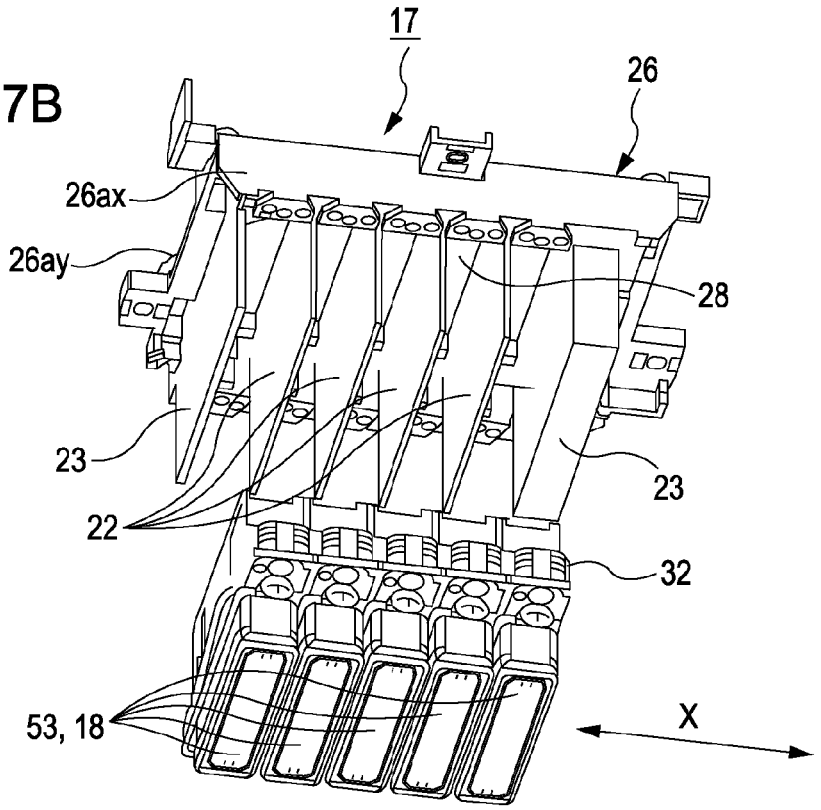
Figure 8:
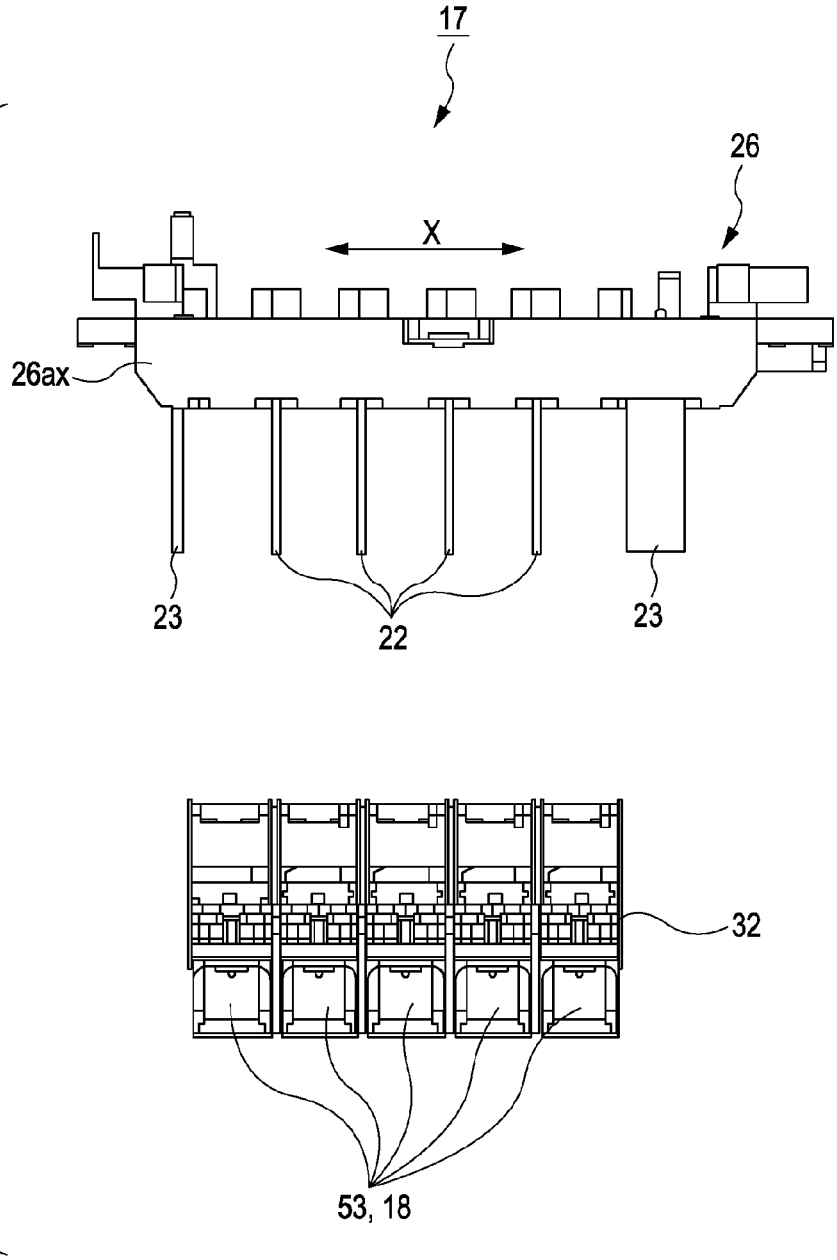
FIG. 8 is an exploded elevation view of the head unit.
Figure 9A:
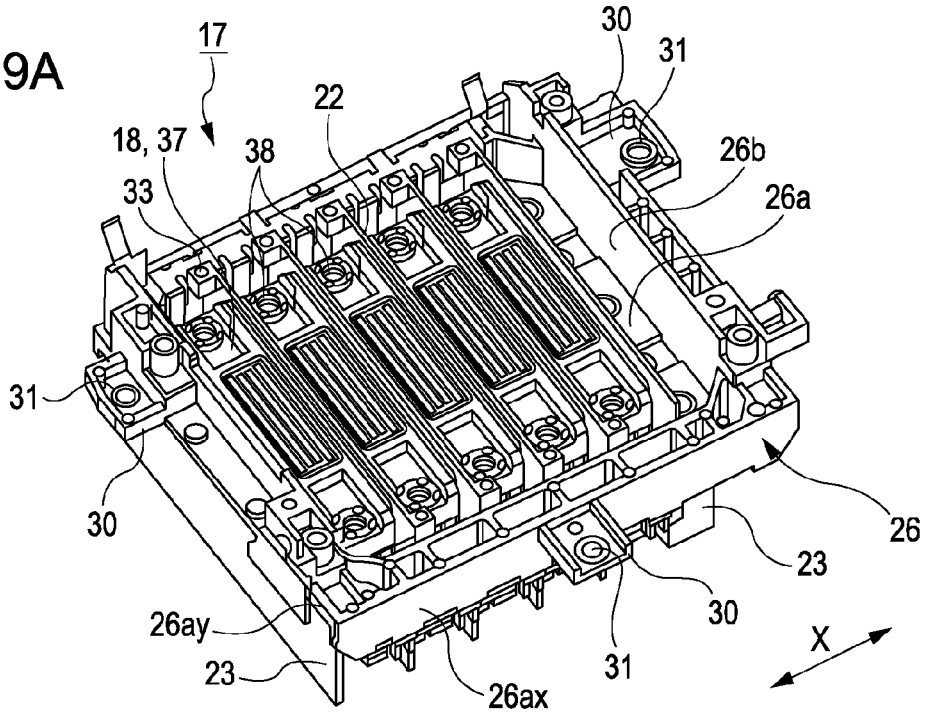
FIGS. 9A and 9B are perspective views of the head unit.
Figure 9B:
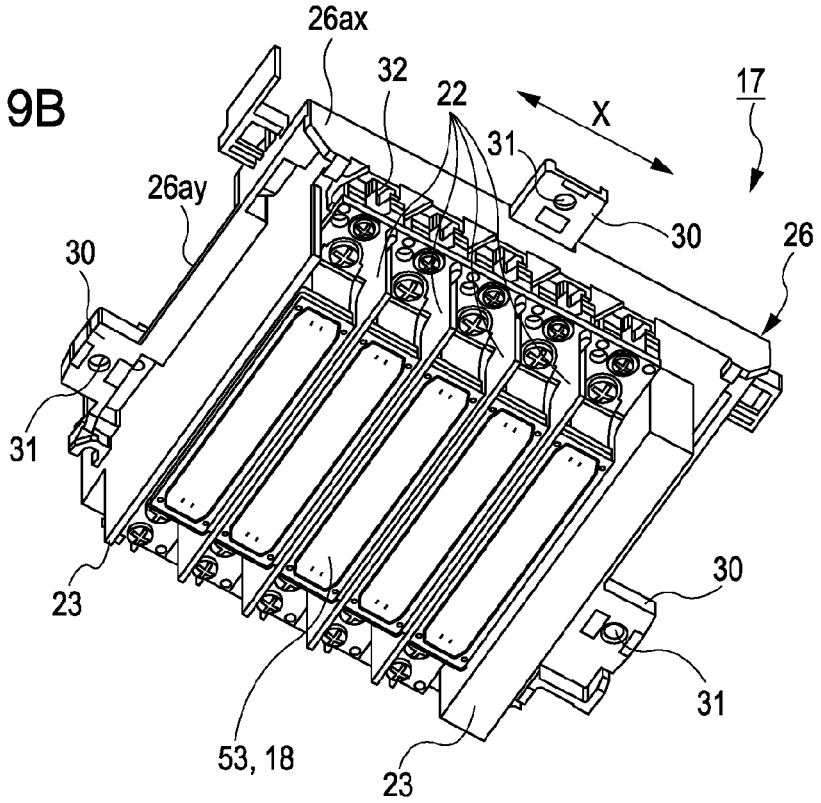
Figure 10:
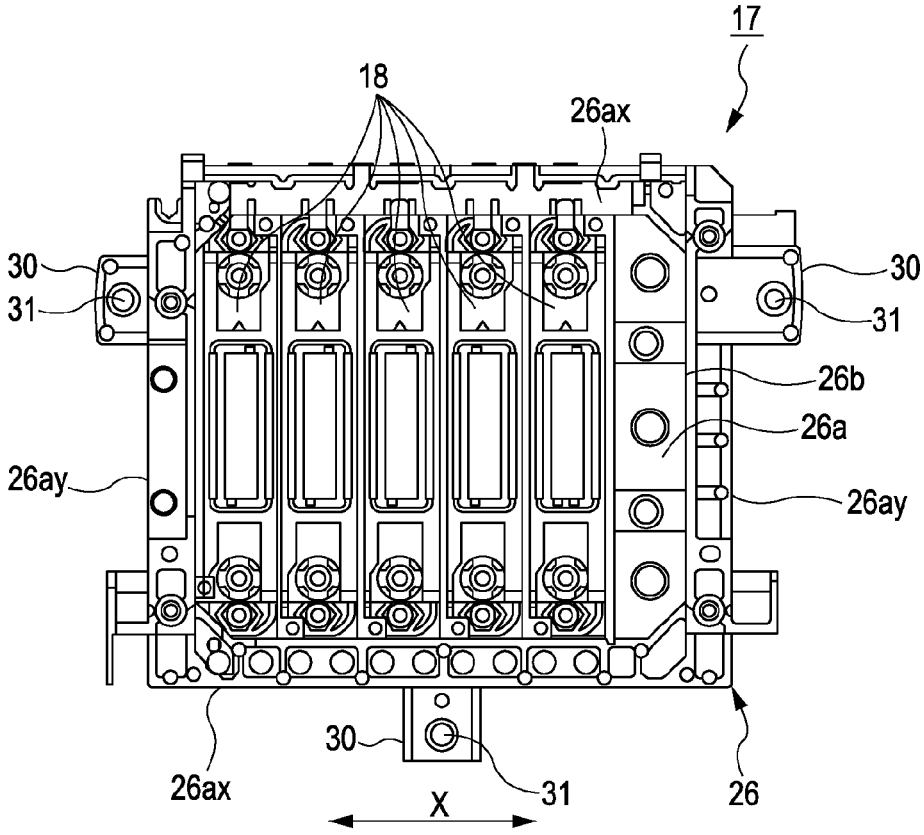
FIG. 10 is a plan view of the head unit.
Figure 11:
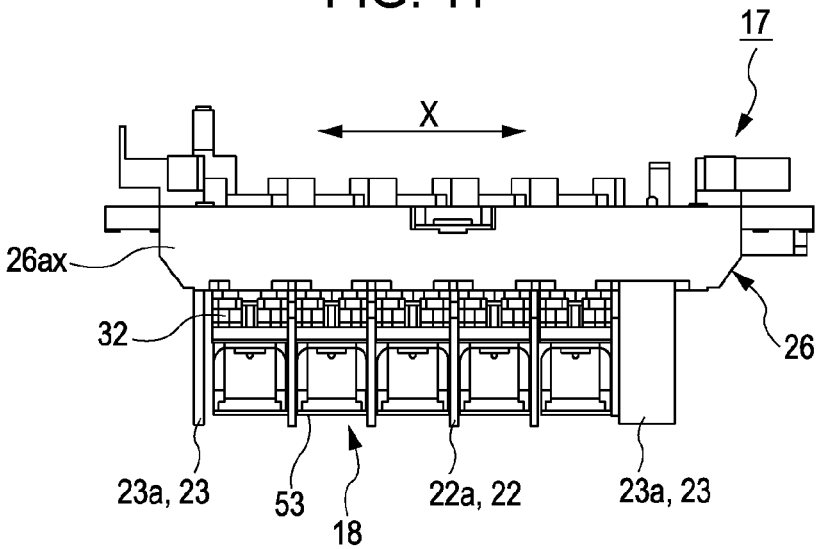
FIG. 11 is an elevation view of the head unit.
Figure 12:
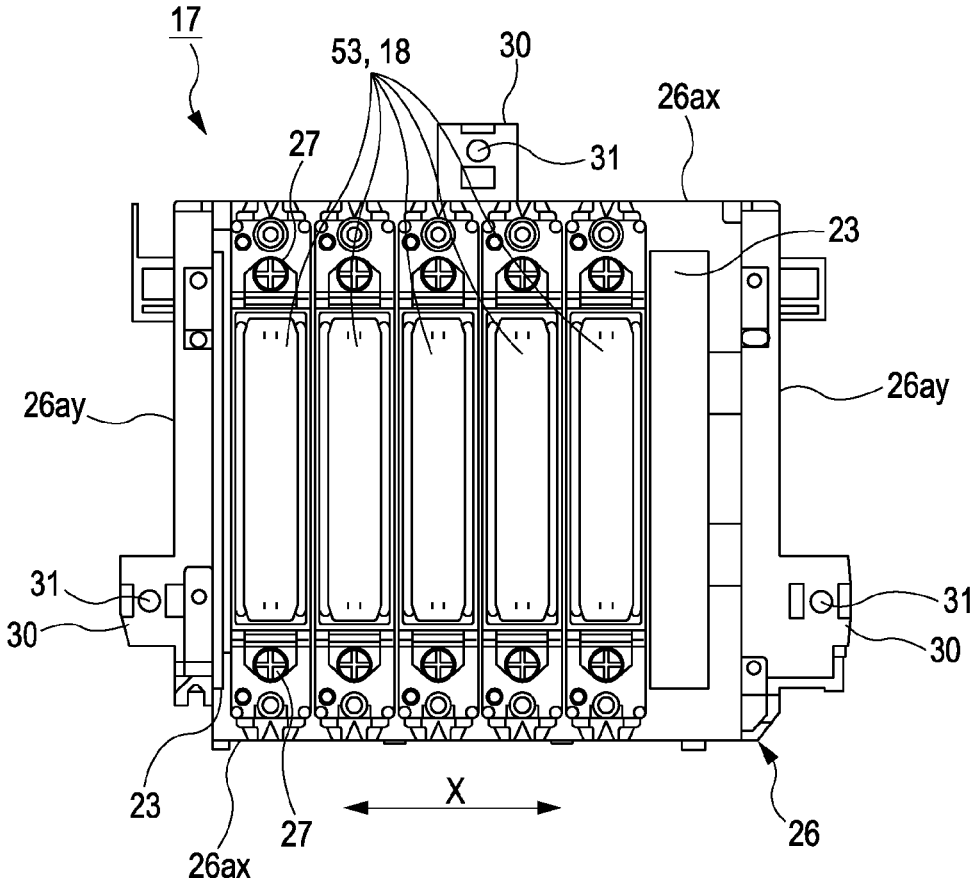
FIG. 12 is a bottom view of the head unit.
Figure 13:
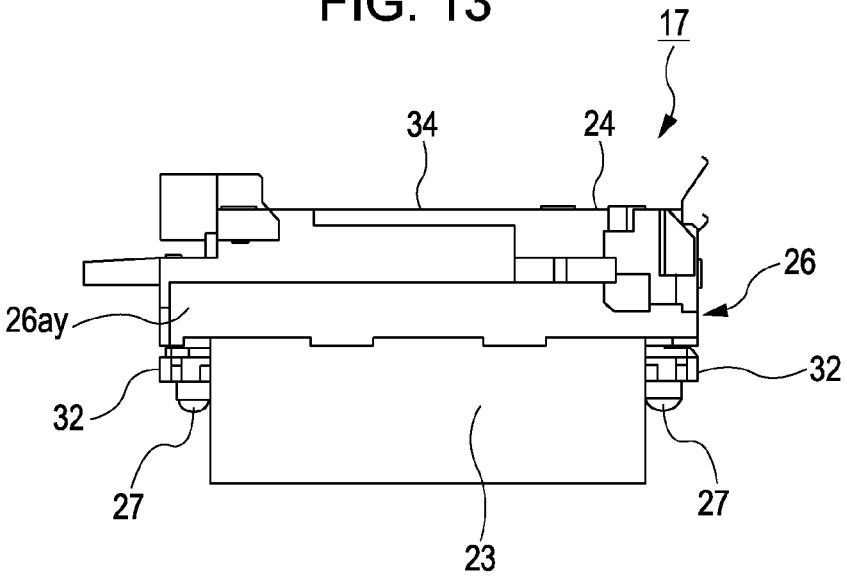
FIG. 13 is an elevation view of the head unit.

FIGS. 7A and 7B are exploded perspective views of the head unit 17: FIG. 7A illustrates the top side and FIG. 7B illustrates the bottom side thereof. FIG. 8 is an exploded elevation view of the head unit 17. FIGS. 9A and 9B are perspective views of the head unit 17: FIG. 9A illustrates the top side and FIG. 9B illustrates the bottom side thereof. FIG. 10 is a plan (top) view of the head unit 17. FIG. 11 is an elevation view of the head unit 17. FIG. 12 is a bottom view of the head unit 17. FIG. 13 is a right side view of the head unit 17.

Figure 14A:
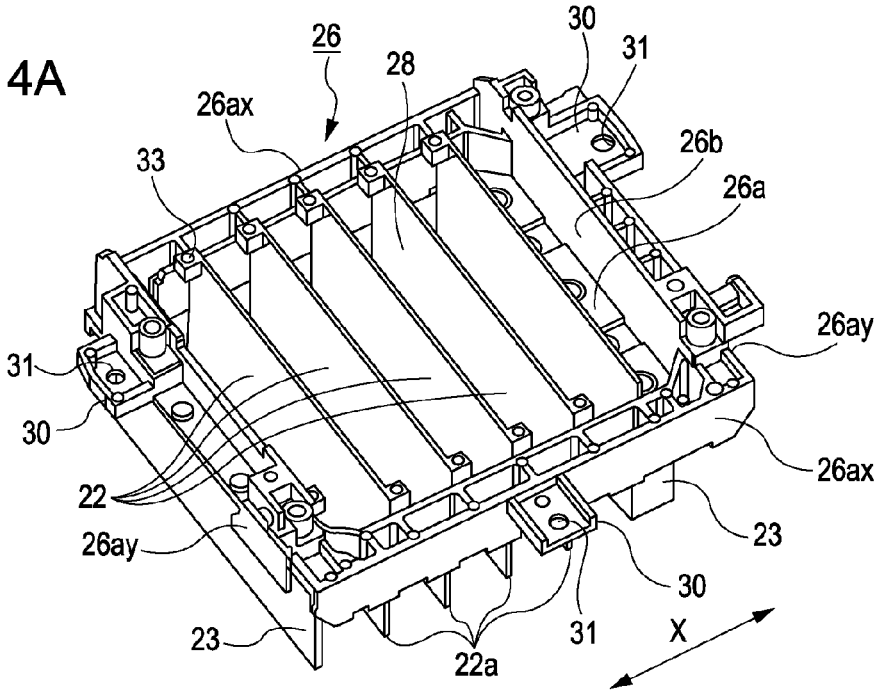
FIGS. 14A and 14B are perspective views of a sub-carriage.
Figure 14B:
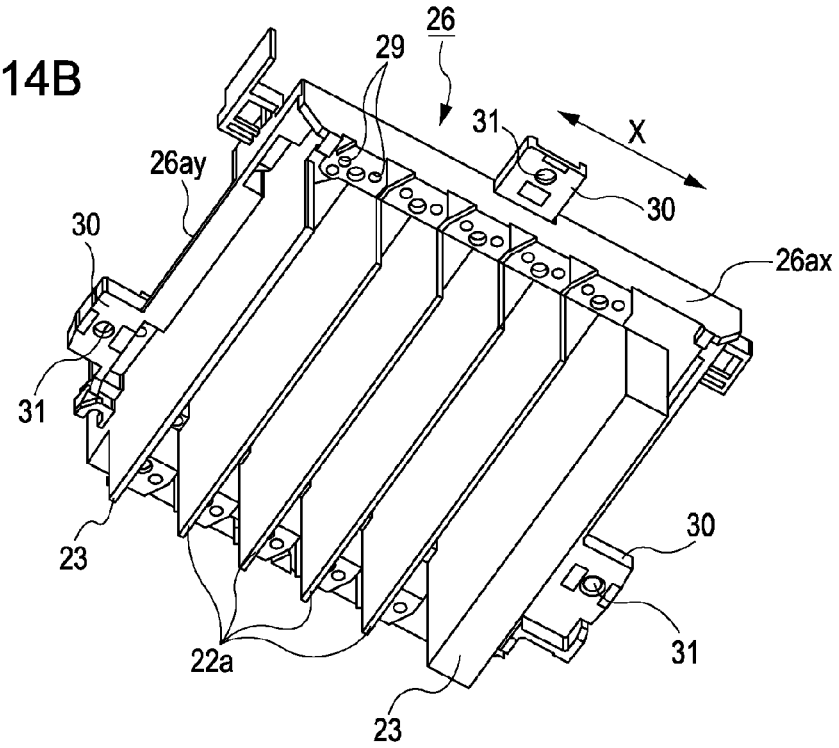
Figure 15:
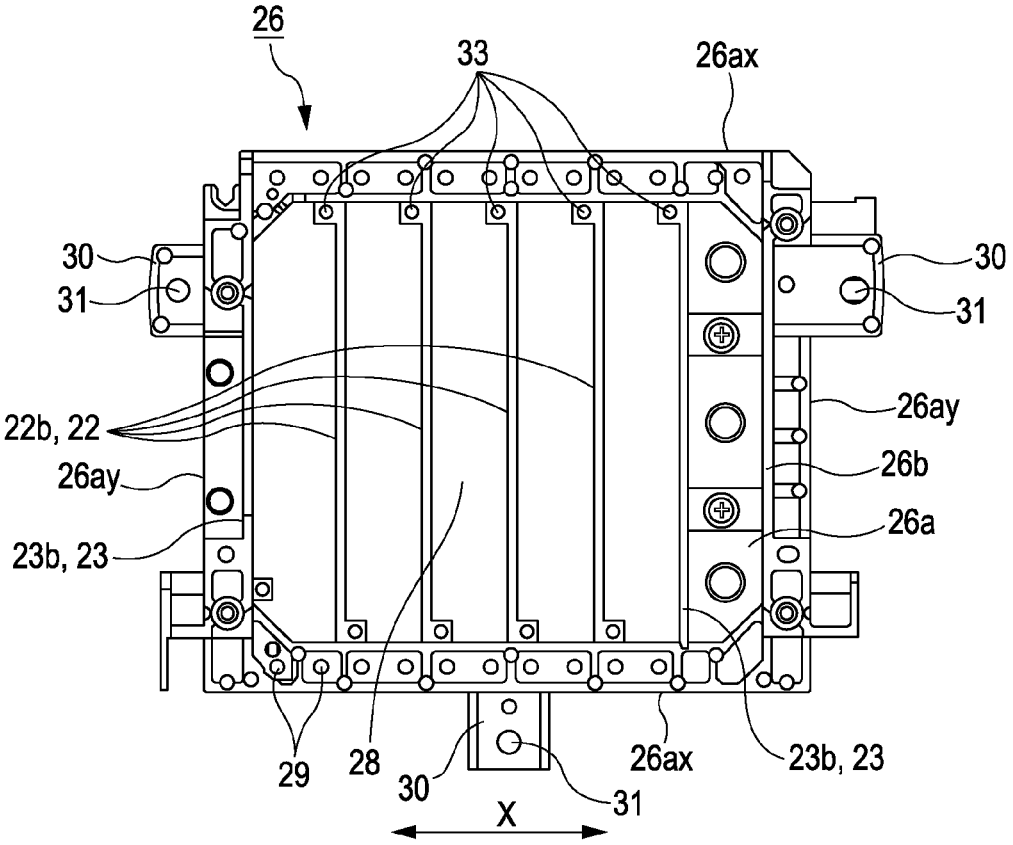
FIG. 15 is a plan view of the sub-carriage.
Figure 16:
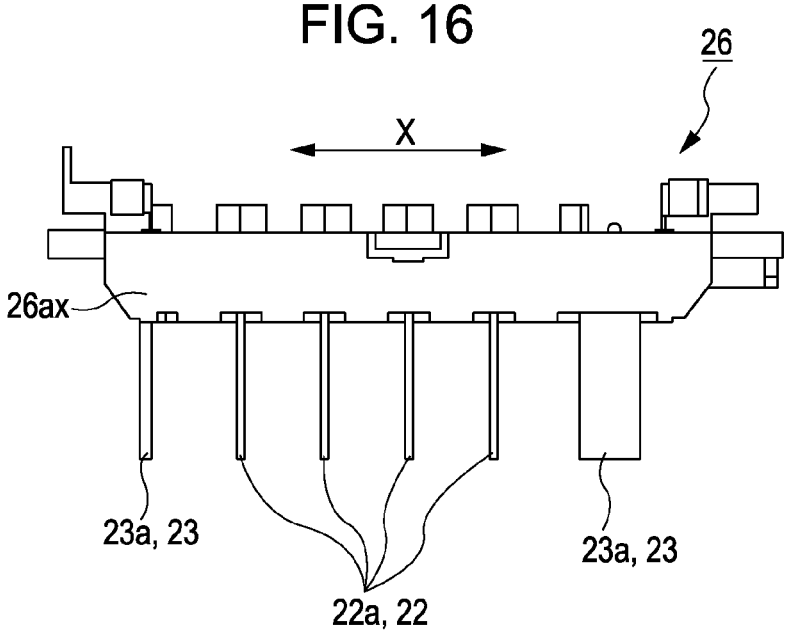
FIG. 16 is an elevation view of the sub-carriage.
Figure 17:
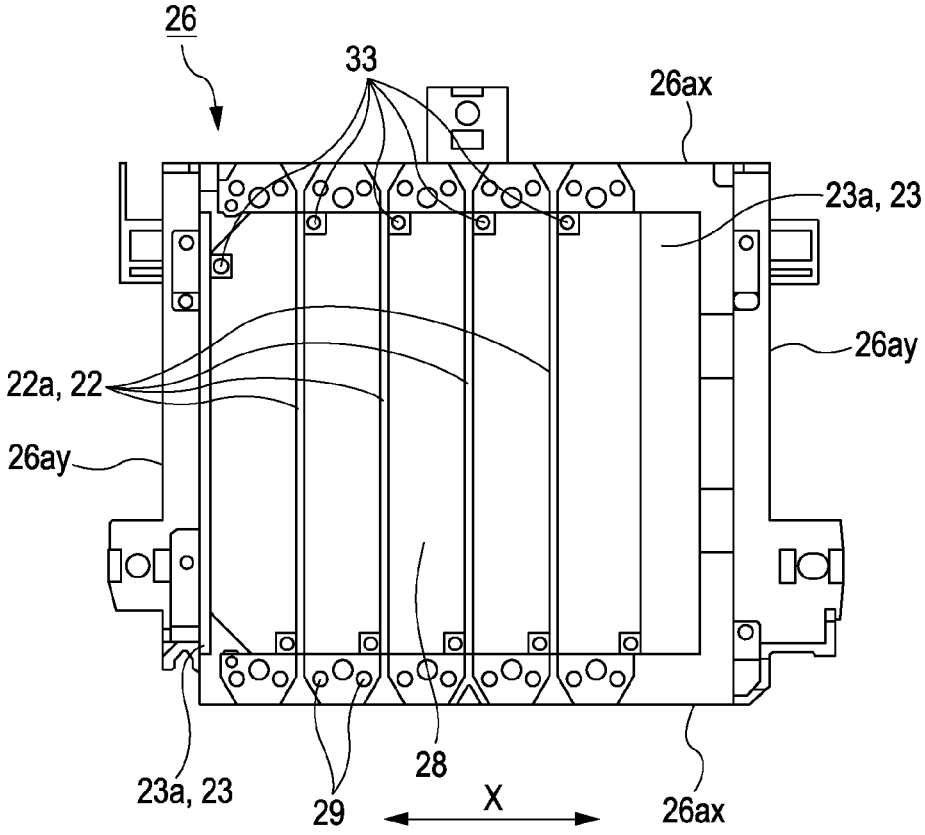
FIG. 17 is a bottom view of the sub-carriage.
Figure 18:
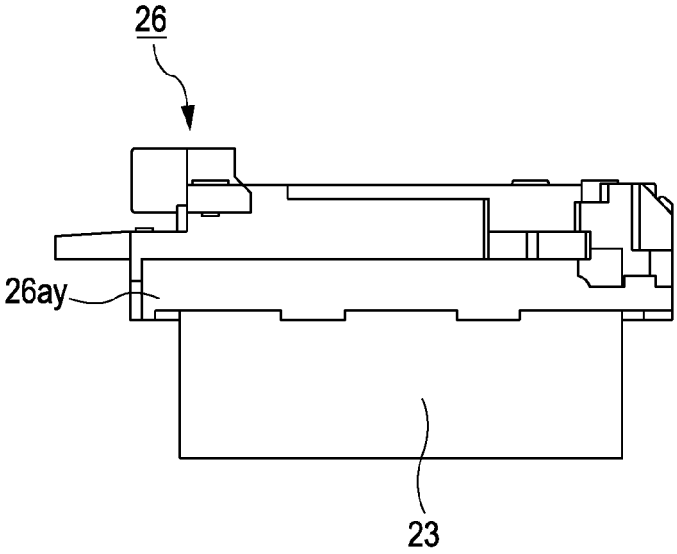
FIG. 18 is a right side view of the sub-carriage.
Figure 19A:
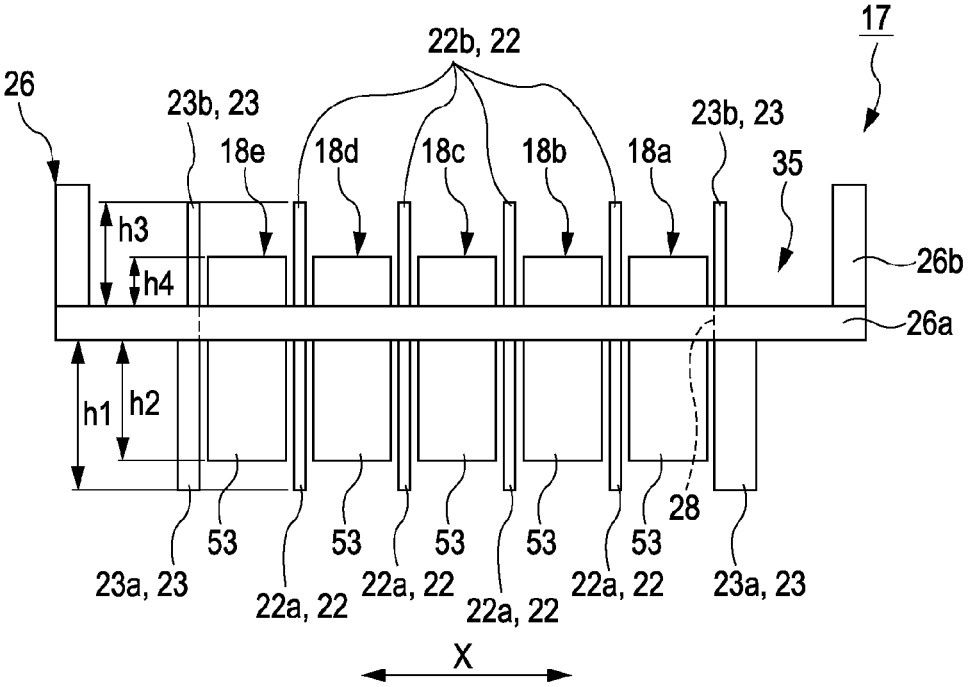
FIG. 19A is an elevation view illustrating a simplified configuration of the head unit.
Figure 19B:
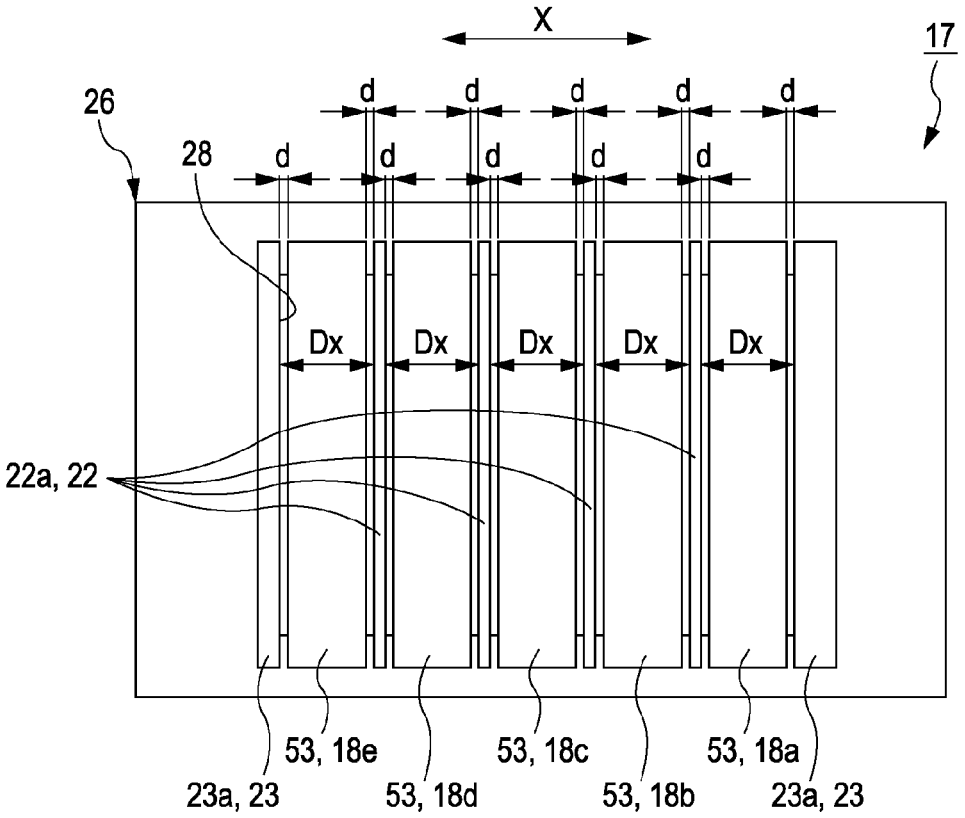
FIG. 19B is a plan view illustrating a simplified configuration of the head unit.

FIGS. 14A and 14B are perspective views of the sub-carriage 26: FIG. 14A illustrates the top side and FIG. 14B illustrates the bottom side thereof. FIG. 15 is a plan (top) view of the sub-carriage 26. FIG. 16 is an elevation view of the sub-carriage 26. FIG. 17 is a bottom view of the sub-carriage 26. FIG. 18 is a right side view of the sub-carriage 26. FIGS. 19A and 19B are sectional views, illustrating a simplified configuration of the head unit 17 for explanation: fixing screw holes 33 for fixing channel members are not illustrated therein.

The head unit 17, as shown in FIGS. 7 to 13, includes a plurality of recording heads 18, etc. as a unit, and has a sub-carriage 26 (a type of head fixing member of the invention) to which the recording heads 18 are fixed, and channel members (not shown).

The sub-carriage 26, as shown in FIGS. 14 to 19, includes a plate base section 26*a* (equivalent to a frame section in the invention) for fixing the recording heads 18, and a standing wall 26*b* that rises from each one of four outer peripheral sides of the base section 26*a*, and is thus formed in a hollow box-like shape with an open top. A space surrounded by the base section 26*a* and the standing walls 26*b* is used as a housing section 35 (see FIG. 19A) that houses at least one portion of each of the recording heads (mainly sub-tanks 37). The sub-carriage 26 of the embodiment is made of a metal such as aluminum, and has high rigidity. Around the center of the base section 26*a*, a head insertion opening 28 (an opening in the invention) is provided as a common opening for every recording head 18, allowing the insertion of a plurality of the recording heads 18. Specifically, the base section 26*a* has a pair of horizontal frame members 26*ax* arranged parallel to each other (first frame members of the invention), and vertical frame members 26*ay* which are parallel to each other and connect the ends of the horizontal frame members (second frame members of the invention) so as to surround the head insertion opening 28. Thus, the base section 26*a* has a frame shape. At the bottom of the base section 26*a* (the side facing a recording medium during recording, described as the bottom in the invention), attaching holes 29 (female screw holes shown in FIG. 17) are provided at the fixing locations of each recording head 18. In this embodiment, at the mounting location of one recording head 18, two attaching holes 29 are provided on both sides in a nozzle row direction with the head insertion opening 28 therebetween, corresponding to the mounting holes (not shown) of spacers 32, totaling four mounting holes.

In the embodiment, each recording head 18 is mounted on the sub-carriage 26 with the spacers 32 therebetween as shown in FIG. 9B and FIG. 11. The spacers 32 are members made of, for instance, a synthetic resin. For every recording head 18, one spacer is mounted on top (on the side of the sub-tank 37) of flange sections 52*a* on both sides (see FIG. 20*a*), totaling two spacers. At the center in the width direction of a spacer 32 (in an orthogonal direction to the nozzle row mounted on the recording heads 18), a head insertion hole (not shown) is provided that corresponds to a spacer mounting hole 54 of the recording heads 18. At both ends in the width direction of the spacer 32, mounting holes (not shown) are provided in correspondence with the attaching holes 29 in the sub-carriage 26. More specifically, each spacer 32 has one head insertion hole and two mounting holes. Before mounting the recording heads 18 into the sub-carriage 26, the spacers 32 are secured to the flange sections 52*a* on both sides of the recording head 18 with spacer fixing screws 27.

The printer 1 in the embodiment can discharge five color inks of cyan (C), magenta (M), yellow (Y), light blue (Lb) and black (K), and has a total of five recording heads (18*a* to 18*e*) that eject each ink. A sub-tank 37 described below is inserted from the bottom of the head insertion opening 28 and is then stored inside a storing section 35. Each recording head 18 is fixed to the base section 26*a* in line with each other in a direction orthogonal to the nozzle rows (the same as the main scanning direction X, described as X direction hereinafter) with gaps therebetween as shown in FIG. 19B. The spacers 32 (see FIGS. 7A and 7B) are provided between the recording heads and the base section 26*a*. As the recording heads 18 are inserted through the head insertion openings 28 and fixed, the nozzle plates 53 and the head case 52 on the side of the nozzle plates 53 protrude from the bottom of the base section 26*a*.

At the bottom of the base section 26*a* of the embodiment, partition plates 22 are provided across the head insertion opening 28 between the recording heads 18 mounted on the sub-carriage 26. More specifically, these partition plates 22 are provided between adjacent head mounting locations, partitioning these mounting positions from each other. The partition plates 22 are fixed (formed) in a suspended state between a pair of the horizontal frame members 26*ax* provided in X direction, straddling the head insertion opening 28. The partition plates 22 are provided so as to extend along the sides in X direction of the recording heads 18 (the sides in a direction orthogonal to the nozzle row), and a portion thereof protrudes from the bottom of the base section 26*a* (bottom facing a recording medium during recording), and rear ends 22*b* on the top side of the base section 26*a* protrude from the top (opposite side to the recording medium during recording). More specifically, as the recording heads 18 are mounted at the head mounting locations in the base section 26*a*, the partition plates 22 face the sides of the recording heads 18 in X direction. As shown in FIG. 19B, the plan view length of the partition plates 22 in the nozzle row direction is about the same as the length of the recording heads 18 in the same direction. Moreover, front ends 22*a* of the partition plates 22 on the bottom side of the base section 26*a* (distance from the base section 26*a* as h1) protrude further than the nozzle plates 53 of the recording heads 18 (distance from the base section 26*a* as h2), and the rear ends 22*b* opposite the front ends 22*a* (distance from the base section 26*a* as h3) protrude further than rear end plates opposite the nozzle plates 53 of the recording heads 18 (distance from the base section 26*a* as h4). More specifically, the height of the partition plates 22 (in the direction perpendicular to the nozzle plates 53 of the recording heads 18) is larger than the length of the recording heads 18 from the nozzle plates 53 to the rear end plates. Additionally, the partition plates 22 may be integrated with the sub-carriage 26 by aluminum die casting, or may be mounted on the sub-carriage 26 separately.

Gaps between the partition plates 22 (indicated by Dx in FIG. 19B) are all the same. Between each partition plate 22 and the recording head 18 adjacent thereto, there is a gap (illustrated as d shown in FIG. 19B). The gap d is set within a range (about 0.2 mm or less) which does not allow the entrance of a recording medium such as recording paper of, for instance, 0.3 mm in thickness. Thus, the length in X direction of the sub-carriage 26 is restrained, protecting the adjacent recording heads 18 against shock from a recording medium or the like.

Outside of the recording head 18*a* (on the right end in FIGS. 19A and 19B) and the recording head 18*e* (on the left end in FIGS. 19A and 19B) in X direction of the recording heads 18 in the frame section 26*a*, an end plate 23 is provided adjacent to each of recording heads 18*a* and 18*e* in an integrated manner with the base section 26*a*. As shown in FIG. 19B, the length of the end plates 23 in the nozzle row direction in the plan view is about the same as the length of the recording heads 18 in the same direction. Moreover, along the sides in X direction from each of the vertical frames 26*ay* to each recording head 18*a* and 18*e*, the front ends 23*a* of the end plates 23 at the bottom side of the base section 26*a* protrude outward and the rear ends 23*b* at the top side of the base section 26*a* protrude from the top side. More specifically, as illustrated in FIG. 19A, the front ends 23*a* of the end plates 23 at the bottom side of the base section 26*a* (distance from the base section 26*a* as h1) are as long as the front ends 22*a* of the partition plates 22, protruding further than the nozzle plates 53 of the recording heads 18 (distance from the base section 26*a* as h2). Moreover, rear ends 23*b* opposite the front ends 23*a* (distance from the base section 26*a* as h3) are as long as the rear ends 22*b* of the partition plates 22, protruding further than the rear end plates opposite the nozzle plates 53 of the recording heads 18 (distance from the base section 26*a* as h4). Specifically, the height of the end plates 23 is larger than the height of the nozzle plates 53 to the rear end plates. Furthermore, the thickness of the end plates 23 in X direction is roughly the same as the thickness of the partition plates 22 on the top side of the base section 26*a* while the end plates 23 are thicker than the partition plates 22 at the bottom side of the base section 26*a*. Among the end plates 23 on both ends, the one on the right end in FIG. 16, etc. is thicker than the other on the left end in FIG. 16, etc. in X direction of the base section 26*a*. These end plates 23 protect the recording heads 18 (especially, the sides of the recording heads 18 on the ends in X direction) from recording paper or the like during recording.

A gap Dx between an end plate 23 and the adjacent partition plate 22 is the same as the gap Dx between the partition plates 22. Additionally, between an end plate 23 and the adjacent recording head 18 (between the recording heads 18*a* and 18*e* on the ends in the row direction herein), as a gap between the partition plates 22, there is a gap d (same as the gap between a partition plate 22 and a recording head 18) within a range of about 0.2 mm or below which does not allow the entrance of a recording medium such as recording paper of, for instance, 0.3 mm in thickness. Thus, the adjacent recording heads 18 are protected against shock from a recording medium or the like, and the aligned recording heads 18 cannot be displaced.

As shown in FIG. 15, etc., at the rear ends 22*b* of the partition plates 22 and the rear ends 23*b* of the end plates 23, fixing screw holes 33 (fixing sections of the invention) are provided to fix a channel member for each ink color (recording head 18). The fixing screw holes 33 are provided in a thick section of the partition plates 22 which is thicker than the other sections in X direction; the holes are arranged at both ends of the partition plates 22 that intersect a pair of the horizontal frame members 26*ax* in plan view so as to be symmetrical with each other with a partition plate 22 therebetween, totaling two holes in each partition plate. A fixing screw hole 33 provided at one end plate 23 (on the right end of FIG. 16, etc.) is provided at the end that intersects one of horizontal frame members 26*ax* (the top one in FIG. 15) in plan view. Moreover, one fixing screw hole 33 at another end plate 23 (the left one in FIG. 16, etc.) is provided at the end plate 23 on the side of the head insertion opening 28 in plan view, slightly away from the base that intersects one horizontal frame member 26*ax* (the bottom one in FIG. 15) toward another horizontal frame member 26*ax*. In fixing each flow member to the sub-carriage 26, the rear end 22*b* of the partition plates 22 and the rear end 23*b* of the end plates 23 (at the top side of the base section 26*a*) function to guide the channel members to mounting positions, and each channel member is fixed to each recording head 18 by attaching and screwing fixing screws (not shown) to the fixing screw holes 33 of the guided channel members.

As shown in FIG. 9, etc., the flange sections 30 are provided at three of four standing walls 26*b* of the sub-carriage 26 so as to protrude outwardly. Insertion holes 31 are provided in the flange sections 30 so as to correspond to three fixing screw holes (not shown in the figures) at the fixing location of the head unit 17 in the bottom section 12*a* of the carriage main body 12. By aligning each fixing screw hole at the bottom section 12*a* of the carriage main body 12 with the corresponding insertion hole 31, head unit fixing screws (not shown) are attached and screwed into the fixing screw holes through the insertion holes 31, thus storing and fixing the head unit 17 inside the carriage main body 12. As described above, before fixing the head unit 17 to the carriage main body 12, the position and inclination of the head unit 17 relative to the carriage main body 12 are adjusted by the adjustment lever 20 described above.

A channel member is a box-shape member provided for each color, and has a small height. The member is made of, for example, synthetic resin. Inside each channel member, an ink supply channel (not shown in the figures) is formed for each color in a channel connecting section 38 of the sub-tank 37 (described below) of each recording head 18. On top of the channel members (a surface opposite the surface mounted to the sub-carriage 26), a tube connecting section (not shown) is provided. When the above-noted ink supply tube 14 is connected to each tube connecting section, an ink supply channel of each color inside the ink supply tube 14 is communicated with an ink introducing port in a tube connecting section in an airtight condition. Accordingly, the ink transported from an ink cartridge through the ink supply tube 14 is introduced to an ink channel inside a channel member through an ink introducing port. The channel members of the embodiment are provided individually to each ink color (each recording head 18), but are not limited to this.

At the bottom of each channel member, a connection channel (not shown) protruding downward is provided at a location corresponding to a channel connecting section 38 of the sub-tank 37 of each recording head 18. The connection channel is a hollow cylindrical member internally having a guide-out path communicated with the ink supply channel of each color. Each connection channel is inserted into each channel connecting section 38 of the sub-tank 37 of each recording head 18, and is connected in an airtight condition. The ink is transported through an ink supply channel inside a channel member, and is then supplied to the sub-tank 37 of each recording head 18 through a connection channel and a channel connecting section. Specifically, an ink supply tube 14 and the sub-tank 37 are connected to each other through a channel member.

Figure 20A:
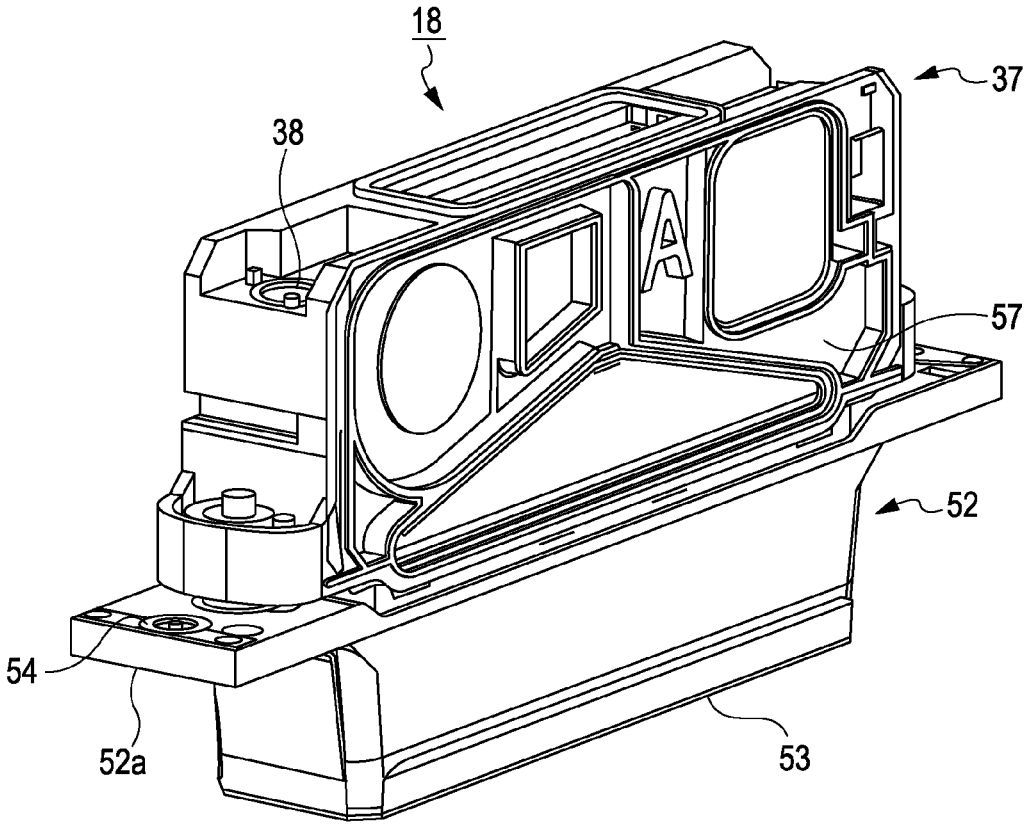
FIGS. 20A and 20B are perspective views for explaining the configuration of a recording head.
Figure 20B:
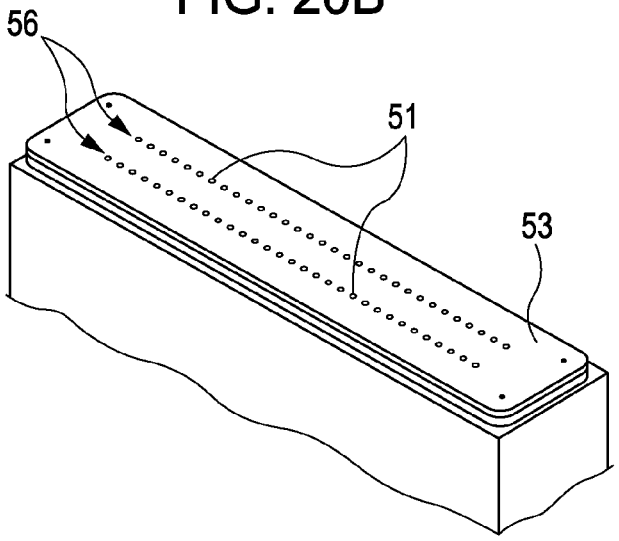

FIGS. 20A and 20B are perspective views, explaining the configuration of the recording heads 18 (a type of liquid ejecting head): FIG. 20A is the top view and FIG. 20B is the bottom view thereof. Each recording head 18 basically has the same structure; thus one of the five recording heads 18 mounted in the sub-carriage 26 is described as a model.

A recording head 18 has a channel unit, which contains a pressure chamber communicated with a nozzle 51 and forms an ink channel, and a pressure generator such as a piezoelectric oscillator or a heating element (not shown) which generates pressure fluctuations in the ink inside the pressure chamber, in a head case 52. The recording head 18 ejects ink from nozzles 51 and causes ink droplets to strike a recording medium such as recording paper so as to perform recording by driving the pressure generator with drive signals from the control section of the printer 1 applied to the pressure generator. Each recording head 18 has nozzle rows 56 (groups of nozzles) in which nozzles 51 for ink ejection are provided in rows, and two nozzle rows 56 are formed in a row direction. Each nozzle row 56 consists of 360 nozzle openings provided at a pitch of, for example, 360 dpi.

The head case 52 is a hollow box member, and a channel unit is fixed to the front end face thereof while the nozzle plates 53 are exposed. Inside a storage section in the head case 52, the pressure generator and the like are stored, and a sub-tank 37 is mounted on the rear end face (top side) opposite the front end face so as to supply ink to the channel unit. On both sides in the nozzle row direction on top of the head case 52, the flange sections 52*a* are formed outwardly. Corresponding to the head insertion holes of the spacers 32, spacer fixing holes 54 are provided in the flange sections 52*a*. In mounting the spacers 32 on the flange sections 52*a*, spacer fixing screws are inserted through the spacer mounting holes 54.

The sub-tank 37 introduces ink from channel members to the pressure chamber of a recording head 18. The sub-tank 37 has a self-sealing function realized by opening and closing a valve based on internal pressure fluctuations and then controlling the flow of ink into the pressure chamber. A flexible thin film 57 is adhered to the left and right surfaces that intersect the direction of the nozzle rows 56 of the sub-tank 37, and has a damper function for absorbing pressure inside the channels. Both ends in the nozzle row direction on the rear end face (top side) of the sub-tank 37 have channel connecting sections 38 to which connecting channels of the channel member described above are connected. Ring-shape packing (not shown) is inserted into the channel connecting section 38 so as to keep a liquid-tight state with the connecting channels. Inside the sub-tank 37, two drive substrates (not shown) are provided so as to supply drive signals to the pressure generator. Each of two flexible cables (wiring members not shown in the figures) which are electrically connected to each drive substrate, are led out to the rear end face of the sub-tank 37. The flexible cables 55 are connected to the signal cables 15, supplying drive signals and the like from the control section of the printer 1 throughout the signal cables 15 to the pressure generator through the drive substrates.

The head unit 17 of the printer 1 of the embodiment has the sub-carriage 26 in which a plurality of the recording heads 18 are arranged in a row with gaps therebetween. The sub-carriage 26 has the head insertion opening 28 in the frame-shape base section 26*a*; the recording heads 18 inserted into the head insertion opening 28 are fixed in a state where the nozzle plates 53 and a portion of each of the nozzle plates 53 protrude from the bottom of the base section 26*a*, and the partition plates 22 are provided parallel to the recording heads 18 across the head insertion opening 28 between the recording heads 18 at the base section 26*a*; a portion of the partition plates 22 protrudes from the bottom of the base section 26*a*, so that the base section 26*a* has more rigidity and the base section 26*a* is expected to have more strength since the partition plates 22 keep their rigidity and function as beams. More specifically, by connecting the horizontal frames 26*ax* (edges of the head insertion opening 28) which face each other with a head insertion opening 28 therebetween, with the partition plates 22, the base section 26*a* can be reinforced. Accordingly, deformation of the sub-carriage 26 is prevented when external force such as vibration or shock is added. Thus, each recording head 18 is prevented from being displaced when external force is applied to the sub-carriage 26. Each recording head 18, in alignment with the sub-carriage 26, and the nozzles 51 are more accurately positioned. As a result, the striking positions of ink droplets will improve.

The gaps between the recording heads 18 are blocked with the partition plates 22, so that even when mist is generated at the nozzle plates 53 by ejecting ink from the nozzles 51, the mist does not easily travel to the side opposite the nozzle plates 53 at the sub-carriage 26. Accordingly, the recording heads 18 become more reliable. Specifically, for instance, when an electronic component such as an electrical substrate is arranged on the side opposite the nozzle plates 53, ink mist or the like is prevented from adhering to the electronic component. Furthermore, when the recording heads 18 are inserted into the head insertion opening 28, the partition plates 22 can be used to guide the recording heads 18 to a mounting location. Thus, the recording heads 18 can be assembled easily. Also, since the head unit 17 can be kept shorter in X direction than the recording member in which reinforcing columns are used between the recording heads 18, the head unit 17 can be reduced in size.

The base section 26*a* surrounds the head insertion opening 28 having a pair of the horizontal frame members 26*ax* provided so as to extend along X direction, as well as a pair of the vertical frame members 26*ay* that are connected to the ends of the horizontal frame members 26*ax*. The partition plates 22 are suspended between the horizontal frame members 26*ax*, and the end plates 23 protruding from the vertical frame members 26*ay* are provided at the base section 26*a* outside in X direction of the recording heads 18*a* and 18*e* on the ends in X direction of the recording heads 18, so that the partition plates 22 and the end plates 23 function as the brims at the sub-carriage 26, thus reinforcing the base section 26*a*. Moreover, with the end plates 23, the sides of the recording head 18 at the ends in X direction of the recording head 18 and the nozzle plates 53 are protected from a recording member transported to a location (on platen) facing the nozzle plates 53 during recording. Accordingly, it is possible to prevent the recording head 18 from being displaced.

The edges 22*a* of the partition plates 22 and the edges 23*a* of the end plates 23 extend from the base section 26*a* further than the nozzle plates 53 of the recording heads 18, so that both sides in X direction of each recording head 18 fixed to the sub-carriage 26 and the nozzle plates 53 may be protected from a recording member that is transported to a location facing the nozzle plates 53 during recording.

The liquid ejecting head unit internally has a channel member that supplies ink for a recording head 18, at each recording head 18. At least one of a partition plate 22 and an end plate 23 has an alignment section for fixing each channel member separately at rear ends that are opposite to front ends with the base section 26*a* therebetween. Thus, the channel members can be easily fixed to the sub-carriage 26 without separately providing fixing sections. Accordingly, only the channel members that are assembled to the sub-carriage 26 can be removed, and an individual channel member can be easily exchanged.

Since the end plates 23 are provided so as to be integrated with the sub-carriage 26, the number of components can be reduced and assembly becomes easier in comparison with the one in which the end plates 23 are separately mounted on the sub-carriage 26.

The invention is not limited to the above-described embodiment, and various modifications may apply based on the description within the range of the claims.

As the embodiment described above, a metallic sub-carriage 26 may be used and may have a heater (not illustrated) for the sub-carriage 26. By heating the sub-carriage 26 containing the partition plates 22 between the recording heads 18 with the heater, the partition plates 22 use heat conducted through the sub-carriage 26, so that the sides of the recording heads 18 can be efficiently heated by the heat radiating from the partition plates 22. Therefore, an ink having a higher viscosity than conventional inks can be smoothly ejected.

Furthermore, the partition plates 22 are provided between the recording heads 18 in the embodiment described above, but the invention is not limited to this. For example, the partition plates 22 may be provided to at least any of the gaps between the recording heads 18. In this case, it is preferable that the gaps between the recording heads 18 with no partition plates 22 be within a range that does not allow the entrance of a recording member.

Ink is ejected onto recording paper while the recording head 18 is shifted back and forth in the embodiment described above, but the invention is not limited to this. For instance, ink may be ejected by shifting recording paper relative to the recording head 18 while the recording head 18 is fixed.

The printer 1 was described as an example of liquid ejecting apparatuses, but the invention may be applied to other liquid ejecting apparatuses, for instance, display manufacturing devices for manufacturing color filters such as liquid displays, electrode manufacturing devices for manufacturing electrodes such as organic EL displays or FEDs, or chip manufacturing devices for biochips (biochemical elements).

What is claimed is:

1. A liquid ejecting apparatus including a liquid ejecting head unit with a plurality of liquid ejecting heads that eject liquid from nozzles, comprising:

the liquid ejecting head unit having a head fixing member that fixes the plurality of liquid ejecting heads arranged in a row with gaps therebetween;

wherein the head fixing member has an opening in a frame section and fixes the plurality of liquid ejecting heads that are inserted into the opening in a state where at least one portion of each of nozzle plates protrudes through the opening;

wherein partition plates are arranged between the liquid ejecting heads in the frame section in a row with the liquid ejecting heads across the opening; and wherein a portion of each of the partition plates protrudes from the bottom of the frame section through which the at least one portion of each of the nozzle plates protrudes.

2. The liquid ejecting apparatus according to claim 1, wherein the frame section has a pair of first frame members provided parallel to each other, and a pair of second frame members that are connected with the ends of the first frame members so as to surround the opening;

wherein the partition plates are suspended between the first frame members; and wherein the frame section has end plates that are outside of the liquid ejecting heads located at the ends in the row direction of the liquid ejecting heads and that protrude along side surfaces located in the mw direction of the liquid ejecting heads from the second frame members.

3. The liquid ejecting apparatus according to claim 2, wherein the edges of at least one of the partition plates and the end plates protrude from the nozzle plates of the liquid ejecting heads outward from the frame section.

4. The liquid ejecting apparatus according to claim 2, wherein the liquid ejecting head unit includes a channel member having an internal liquid channel that supplies liquid to the liquid ejecting heads, for each liquid ejecting head; and wherein at least either one of the partition plates and the end plates have fixing sections at rear ends on the opposite side from the frame section so as to fix the channel members individually.

5. The liquid ejecting apparatus according to claim 2, wherein the head fixing member is metallic and has a heater.

6. The liquid ejecting apparatus according to claim 2, wherein the end plates are provided so as to be integrated with the head fixing member.

* * * * *